US010411330B1

(12) United States Patent
Yun et al.

(10) Patent No.: US 10,411,330 B1
(45) Date of Patent: Sep. 10, 2019

(54) ANTENNA ASSEMBLY FOR WIRELESS DEVICE

(71) Applicant: TE CONNECTIVITY CORPORATION, Berwyn, PA (US)

(72) Inventors: Xing Yun, Harrisburg, PA (US); Bruce Foster Bishop, Aptos, CA (US); John Wesley Hall, Harrisburg, PA (US); Neil Franklin Schroll, Mount Joy, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/974,270

(22) Filed: May 8, 2018

(51) Int. Cl.

| | |
|---|---|
| ***H01Q 1/24*** | (2006.01) |
| ***H01Q 1/48*** | (2006.01) |
| ***H01Q 21/30*** | (2006.01) |
| ***H01Q 21/06*** | (2006.01) |

(52) U.S. Cl.
CPC ..... *H01Q 1/243* (2013.01); *H01Q 1/48* (2013.01); *H01Q 21/062* (2013.01); *H01Q 21/30* (2013.01)

(58) Field of Classification Search
CPC ..... H01Q 1/24; H01Q 1/243; H01Q 1/48; H01Q 15/00; H01Q 21/062; H01Q 21/30
See application file for complete search history.

(56) References Cited

U.S. PATENT DOCUMENTS

| | | | |
|---|---|---|---|
| 6,362,789 | B1 | 3/2002 | Trumbull et al. |
| 6,414,637 | B2 | 7/2002 | Keilen |
| 6,515,627 | B2 | 2/2003 | Lopez et al. |
| 7,253,780 | B2 | 8/2007 | Sievenpiper |
| 7,592,957 | B2 | 9/2009 | Achour et al. |
| 7,764,232 | B2 | 7/2010 | Achour et al. |
| 7,847,739 | B2 | 12/2010 | Achour et al. |
| 7,855,696 | B2 | 12/2010 | Gummalla et al. |
| 7,911,386 | B1 | 3/2011 | Itoh et al. |
| 8,063,839 | B2 | 11/2011 | Ansari et al. |
| 8,299,967 | B2 | 10/2012 | Xu et al. |
| 8,866,685 | B2 * | 10/2014 | Lee ..... H01Q 5/00 343/770 |
| 2002/0130734 | A1 | 9/2002 | Liang et al. |

(Continued)

FOREIGN PATENT DOCUMENTS

| | | | |
|---|---|---|---|
| CN | 101436713 | A | 5/2009 |
| CN | 101447602 | A | 6/2009 |

OTHER PUBLICATIONS

Chinese Office Action for corresponding CN Application No. 201310125022.6 dated Jan. 13, 2015 (14 pages).

(Continued)

*Primary Examiner* — Hoang V Nguyen

(57) ABSTRACT

An antenna assembly for a wireless device includes an antenna cable having a feed line and a ground shield and a substrate. The antenna includes a low band ground terminal, a low band feed terminal, a high band ground terminal and a high band feed terminal. The low band ground terminal is electrically coupled to the ground shield of the antenna cable and capacitively coupled to the feed line of the antenna cable. The low band feed terminal is electrically coupled to the feed line of the antenna cable. The high band ground terminal is electrically coupled to the ground shield of the antenna cable and capacitively coupled to the feed line of the antenna cable. The high band feed terminal is electrically coupled to the feed line of the antenna cable. The low band ground terminal and the high band ground terminal are ground plane independent.

20 Claims, 3 Drawing Sheets

(56) References Cited

U.S. PATENT DOCUMENTS

| | | | | |
|---|---|---|---|---|
| 2004/0066251 | A1 | 4/2004 | Eleftheriades et al. | |
| 2005/0001769 | A1 | 1/2005 | Qi et al. | |
| 2007/0176827 | A1 | 8/2007 | Itoh et al. | |
| 2009/0128446 | A1 | 5/2009 | Gummalla et al. | |
| 2009/0135087 | A1 | 5/2009 | Gummalla et al. | |
| 2009/0245146 | A1 | 10/2009 | Gummalla et al. | |
| 2010/0060544 | A1 | 3/2010 | Penev et al. | |
| 2010/0073254 | A1 | 3/2010 | Lee et al. | |
| 2010/0109971 | A2 | 5/2010 | Gummalla et al. | |
| 2010/0123635 | A1 | 5/2010 | Lopez et al. | |
| 2012/0329524 | A1 | 12/2012 | Kent et al. | |
| 2016/0190681 | A1* | 6/2016 | Huang | H01Q 9/42 343/845 |
| 2017/0047651 | A1* | 2/2017 | Zuniga | H01Q 1/38 |

OTHER PUBLICATIONS

California Eastern Laboratories (CEL), Data Sheet—CMOS Integrated Circuit μPD5713TK, "Wide Band SPDT Switch", Doc. No. PU1627EJ01 VODS (1 st edition), pp. 1-10, Sep. 2006.

Calox et al., "Electromagnetic Metamaterials: Transmission Line Theory and Microwave Applications", John Wiley & Sons (2006). (186 pages).

Itoh "Invited Paper: Prospects for Metamaterials," Electronics Letters, 40(16); 972-973, Aug. 2004 (2 pages).

Lai et al., "Infinite Wavelength Resonant Antennas with Monopolar Radiation Pattern Based on Period Structures," IEEE Transactions on Antennas and Propagation, vol. 55(3), Mar. 2007, (9 pages).

Wu et al., "A Novel Small Planar Antenna Utilizing Cascaded Right/Left-Handed Transmission Lines," IEE Antennas and Propagation Society International Symposium 2007, Jun. 9-15, 2007, Honolulu, HI USA, Jun. 2007 (4 pages).

Lim et al., "Metamaterial-Based Electronically Controlled Transmission-Line Structure as a Novel Leaky-Wave Antenna with Tunable Radiation Angel and Beamwidth," IEEE Transactions on Microwave Theory and Techniques, vol. 52(12), Dec. 2004,; (13 pages).

Extended European Search Report for European Application No. 13163154.1, dated Jun. 6, 2013 (4 pages).

* cited by examiner

ANTENNA ASSEMBLY FOR WIRELESS DEVICE

BACKGROUND OF THE INVENTION

The subject matter herein relates generally to antenna assemblies for wireless devices.

Wireless devices or wireless communication devices have use in many applications including telecommunications, computers, vehicles and other applications. Examples of wireless devices include mobile phones, cellular modems, tablets, notebook computers, laptop computers, desktop computers, handsets, personal digital assistants (PDAs), a wireless access point (AP) such as a WiFi router, a base station in a wireless network, a wireless communication USB dongle or card (e.g., PCI Express card or PCMCIA card) for computers, and other devices. The wireless devices include antennas that allow for wireless communication with the device. Several antenna characteristics are usually considered in selecting an antenna for a wireless device, including the size, voltage standing wave ratio (VSWR), gain, bandwidth, and the radiation pattern of the antenna.

Known antennas for wireless devices have several disadvantages, such as limited bandwidth, large size, interference from other nearby objects, and the like. Additionally, it may be desirable for wireless devices to operate in different bandwidths. For example, in automotive applications, vehicles may be used in different areas of the world generally having different LTE bands (e.g., North America, South America, Europe, Asia, Africa and the like). Some known antennas for wireless devices address some of the antenna problems using composite right and left handed (CRLH) metamaterials for the antennas. For example, U.S. Pat. No. 7,764,232 to Achour, the subject matter of which is incorporated by reference in its entirety, describes antennas using CRLH metamaterial structures. Such antennas have expanded bandwidth to cover broader frequency ranges, but still run into bandwidth limitations.

It is desirable with systems today to use wireless devices that operate in multiple frequency bands simultaneously or to use wireless devices that effectively operate in specific radio bands and are able to remotely select such bands for different networks. Known antennas for wireless devices are not able to effectively address these needs, at least in part due to bandwidth limitations.

A need remains for an antenna that effectively operates in a broad frequency bandwidth while having a small physical antenna size.

BRIEF DESCRIPTION OF THE INVENTION

In one embodiment, an antenna assembly for a wireless device is provided including an antenna cable having a feed line and a ground shield coaxial with the feed line and a substrate having a feed line mounting pad and a ground shield mounting pad. The antenna includes a low band ground terminal, a low band feed terminal, a high band ground terminal and a high band feed terminal. The low band ground terminal is on the substrate and operable in a low frequency bandwidth. The low band ground terminal is electrically coupled to the ground shield of the antenna cable and capacitively coupled to the feed line of the antenna cable. The low band feed terminal is operable in a low frequency bandwidth and electrically coupled to the feed line of the antenna cable. The high band ground terminal is operable in a high frequency bandwidth. The high band ground terminal is electrically coupled to the ground shield of the antenna cable and capacitively coupled to the feed line of the antenna cable. The high band feed terminal is operable in a high frequency bandwidth and electrically coupled to the feed line of the antenna cable. The low band ground terminal and the high band ground terminal are ground plane independent.

In another embodiment, an antenna assembly for a wireless device is provided including an antenna cable having a feed line and a ground shield coaxial with the feed line and a substrate having discrete conductive elements defining a feed line mounting pad, a ground shield mounting pad, a low band ground terminal, a low band feed terminal, a high band ground terminal and a high band feed terminal. The low band ground terminal is operable in a low frequency bandwidth. The low band ground terminal is electrically coupled to the ground shield of the antenna cable and being capacitively coupled to the feed line of the antenna cable. The conductive element defining the low band ground terminal is capacitively coupled to the conductive element defining the low band feed terminal. The low band feed terminal is operable in a low frequency bandwidth. The low band feed terminal is electrically coupled to the feed line of the antenna cable. The high band ground terminal is operable in a high frequency bandwidth. The high band ground terminal is electrically coupled to the ground shield of the antenna cable and capacitively coupled to the feed line of the antenna cable. The conductive element defining the high band ground terminal is capacitively coupled to the conductive element defining the high band feed terminal. The high band feed terminal is operable in a high frequency bandwidth. The high band feed terminal is electrically coupled to the feed line of the antenna cable. The low band ground terminal and the high band ground terminal are ground plane independent.

In one embodiment, an antenna assembly for a wireless device is provided including an antenna cable having a feed line and a ground shield coaxial with the feed line and a substrate having a feed line mounting pad and a ground shield mounting pad. The antenna includes a low band ground terminal, a low band feed terminal, a high band ground terminal and a high band feed terminal. The low band ground terminal is on the substrate and operable in a low frequency bandwidth. The low band ground terminal is electrically coupled to the ground shield of the antenna cable and capacitively coupled to the feed line of the antenna cable. The low band feed terminal is operable in a low frequency bandwidth and electrically coupled to the feed line of the antenna cable. The high band ground terminal is operable in a high frequency bandwidth. The high band ground terminal is electrically coupled to the ground shield of the antenna cable and capacitively coupled to the feed line of the antenna cable. The high band feed terminal is operable in a high frequency bandwidth and electrically coupled to the feed line of the antenna cable. The low band ground terminal and the high band ground terminal are ground plane independent. The antenna includes a tuning element on the substrate being operatively coupled to at least one of the low band ground terminal, the low band feed terminal, the high band ground terminal and the high band feed terminal.

DETAILED DESCRIPTION OF THE INVENTION

Embodiments set forth herein include an antenna assembly having an antenna electrically connected to an antenna cable. Various embodiments of the antenna described herein include a multi-band antenna circuit. For example, various embodiments described herein include an antenna circuit operable in a low frequency band and a high frequency band. Various embodiments may include a dual dipole antenna circuit. The dual dipole antenna circuit may be operable in different frequency bands, such as in different Wi-Fi frequency bands. For example, in various embodiments described herein include an antenna circuit operable within frequency ranges of 698 to 960 MHz, 1.4 to 3.5 GHz and 3.8 to 4 GHz, which provides frequency coverage and enables use in many discrete worldwide cellular bands. The antenna circuit may be operable in other frequency ranges in other various embodiments. The antenna element may have a wide bandwidth. Various embodiments described herein have an antenna arranged for omnidirectional performance. For example, the antenna element is arranged in a housing for omnidirectional performance.

Embodiments may communicate within one or more radio-frequency (RF) bands. For purposes of the present disclosure, the term "RF" is used broadly to include a wide range of electromagnetic transmission frequencies including, for instance, those falling within the radio frequency, microwave, or millimeter wave frequency ranges. An RF band may also be referred to as a frequency band. An antenna assembly may communicate through one or more RF bands (or frequency bands). In particular embodiments, the antenna assembly communicates through multiple frequency bands. It should be understood that antenna assemblies described herein are not limited to particular wireless technologies (e.g., LTE, WLAN, Wi-Fi, WiMax) and other wireless technologies may be used.

Figure 1:
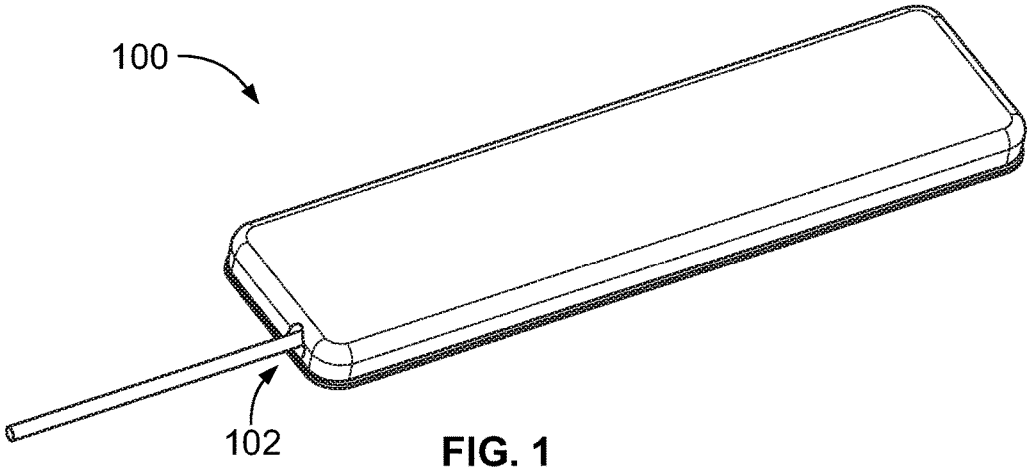
FIG. 1 illustrates a wireless device formed in accordance with an exemplary embodiment.

FIG. 1 illustrates a wireless device 100 formed in accordance with an exemplary embodiment. The wireless device 100 includes an antenna assembly 102. The wireless device 100 may be used in a telecommunications application, an automotive application, a computer application or other applications. In various embodiments, the wireless device 100 may be a cellular modem for a vehicle. For example, the wireless device 100 is or forms part of a telematics unit positioned within a vehicle, such as an automotive vehicle. In other various embodiments, the wireless device 100 may be a mobile phone, a tablet, a notebook computer, a laptop computer, a desktop computer, a handset, a PDA, a wireless access point (AP) such as a WiFi router, a base station in a wireless network, a wireless communication USB dongle or card (e.g., PCI Express card or PCMCIA card) for a computer, or another type of wireless device. The antenna assembly 102 allows for wireless communication to and/or from the wireless device 100.

Although not shown, the wireless device 100 may include system circuitry having a module (e.g., transmitter/receiver) that decodes the signals received from the antenna assembly 102 and/or transmitted by the antenna assembly 102. In other embodiments, however, the module may be a receiver that is configured for receiving only. The system circuitry may also include one or more processors (e.g., central processing units (CPUs), microcontrollers, field programmable arrays, or other logic-based devices), one or more memories (e.g., volatile and/or non-volatile memory), and one or more data storage devices (e.g., removable storage device or non-removable storage devices, such as hard drives). The system circuitry may also include a wireless control unit (e.g., mobile broadband modem) that enables the wireless device 100 to communicate via a wireless network. The wireless device 100 may be configured to communicate according to one or more communication standards or protocols (e.g., LTE, Wi-Fi, Bluetooth, cellular standards, etc.).

During operation of the wireless device 100, the wireless device 100 may communicate through the antenna assembly 102. To this end, the antenna assembly 102 may include conductive elements that are configured to exhibit electromagnetic properties that are tailored for desired applications. For instance, the antenna assembly 102 may be configured to operate in multiple RF bands simultaneously. The structure of the antenna assembly 102 can be configured to effectively operate in particular RF bands. The structure of the antenna assembly 102 can be configured to select specific RF bands for different networks. The antenna assembly 102 may be configured to have designated performance properties, such as a voltage standing wave ratio (VSWR), gain, bandwidth, and a radiation pattern.

The structure of the antenna assembly 102 can be structured and engineered to exhibit electromagnetic properties that are tailored for specific applications and can be used in applications where the antennas operate in multiple frequency bands simultaneously. The structure of the antenna assembly 102 can be structured and engineered to effectively operate in specific radio bands. The structure of the antenna assembly 102 can be structured and engineered to remotely select specific radio bands for different networks. The structure of the antenna assembly 102 can be structured and engineered to have a small physical antenna size while effectively operating in a broad frequency bandwidth. The structure of the antenna assembly 102 can be structured and engineered to dynamically tune the antenna within one or more frequency bands.

The antenna assembly 102 may include a particular arrangement of conductive elements, such as conductive elements formed by one or more circuits on a circuit board. The size, shape, and positioning of the conductive elements are designed for a particular application and may be changed to provide different characteristic for the antenna assembly 102, such as being designed to operate at different frequencies. The different conductive elements allow the antenna assembly 102 to be used in different frequency bands. The antenna assembly 102 has a wide bandwidth by use of multiple conductive elements.

The antenna assembly 102 may use right hand mode elements and/or left hand mode elements having different electromagnetic modes of propagation to operate efficiently at various frequency bands. In an exemplary embodiment, the antenna assembly 102 includes both right handed mode antenna elements and left handed mode antenna elements. The right handed mode antenna elements have electromagnetic wave propagation that obeys the right handed rule for the electrical field, the magnetic field, and the wave vector. The phase velocity direction is the same as the direction of the signal energy propagation (group velocity) and the refractive index is a positive number. The left handed mode antenna elements are manufactured from a metamaterial structure that exhibits a negative refractive index where the phase velocity direction is opposite to the direction of the signal energy propagation. The relative directions of the vector fields follow the left handed rule.

The antenna assembly 102 may be manufactured from a metamaterial structure that is a mixture of left handed metamaterials and right handed metamaterials to define a combined structure that behaves like a left handed metamaterial structure at low frequencies and a right handed material at high frequencies. The antenna structure exhibits both left hand and right hand electromagnetic modes of propagation, which may depend on the frequency of operation. Designs and properties of various metamaterials are described in U.S. Pat. No. 7,764,232 to Achour, the subject matter of which is incorporated by reference in its entirety.

Figure 2:
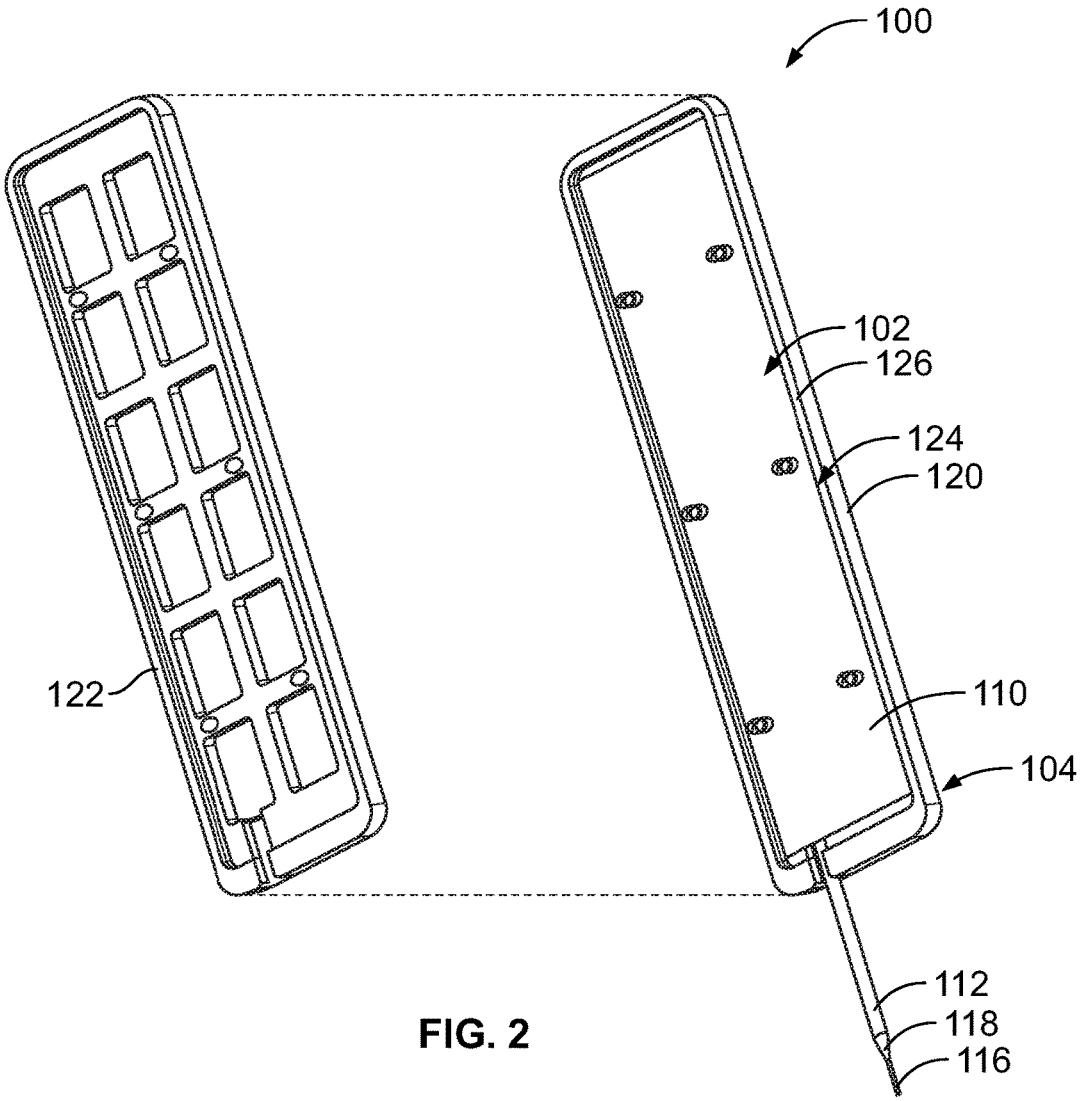
FIG. 2 is an exploded view of the wireless device showing a housing and an antenna assembly of the wireless device.

FIG. 2 is an exploded view of the wireless device 100 showing a housing 104 and the antenna assembly 102 in the housing 104. The antenna assembly 102 includes an antenna 110 and an antenna cable 112 terminated to the antenna 110. The antenna cable 112 may be a coaxial cable routed from the housing 104 to another component, such as a telematics unit of a vehicle. In an exemplary embodiment, the antenna cable 112 includes a feed line 116 and a ground line defined by a ground shield 118 coaxial with the feed line 116. The feed line 116 and the ground shield 118 are configured to be electrically connected to the antenna 110. The feed line 116 provides feeds radio waves to the antenna 110 and/or collects the incoming radio waves and converts them to electric currents to transmit them to a receiver or other component.

In an exemplary embodiment, the ground shield 118 provides the ground source for the conductive elements of the antenna 110. The antenna 110 does not include a separate ground plane within or on the substrate of the antenna 110. As such, the conductive elements of the antenna 110 are ground plane independent. In the illustrated embodiment, the feed line 116 is a center conductor of the coaxial cable and the ground shield 118 is an outer shield of the coaxial cable separated from the feed line 116 by an insulator and surrounded by a jacket of the antenna cable 112.

The housing 104 holds the antenna 110. In an exemplary embodiment, the housing 104 holds the antenna 110 in a vertical orientation; however, other orientations are possible in alternative embodiments. In an exemplary embodiment, the housing 104 is a multi-piece housing, such as including a first shell 120 and a second shell 122. The first shell 120 and the second shell 122 define a cavity 124 that receives the antenna 110. The antenna cable 112 extends into the cavity 124 for electrical connection with the antenna 110. The antenna cable 112 extends to an exterior of the housing 104 and is routed away from the housing 104. The first shell 120 and the second shell 122 meet at an interface 126. In an exemplary embodiment, the antenna cable 112 extends from the housing 104 at the interface 126. For example, the antenna cable 112 may be sandwiched between the first shell 120 and the second shell 122 at the interface 126.

Figure 3:
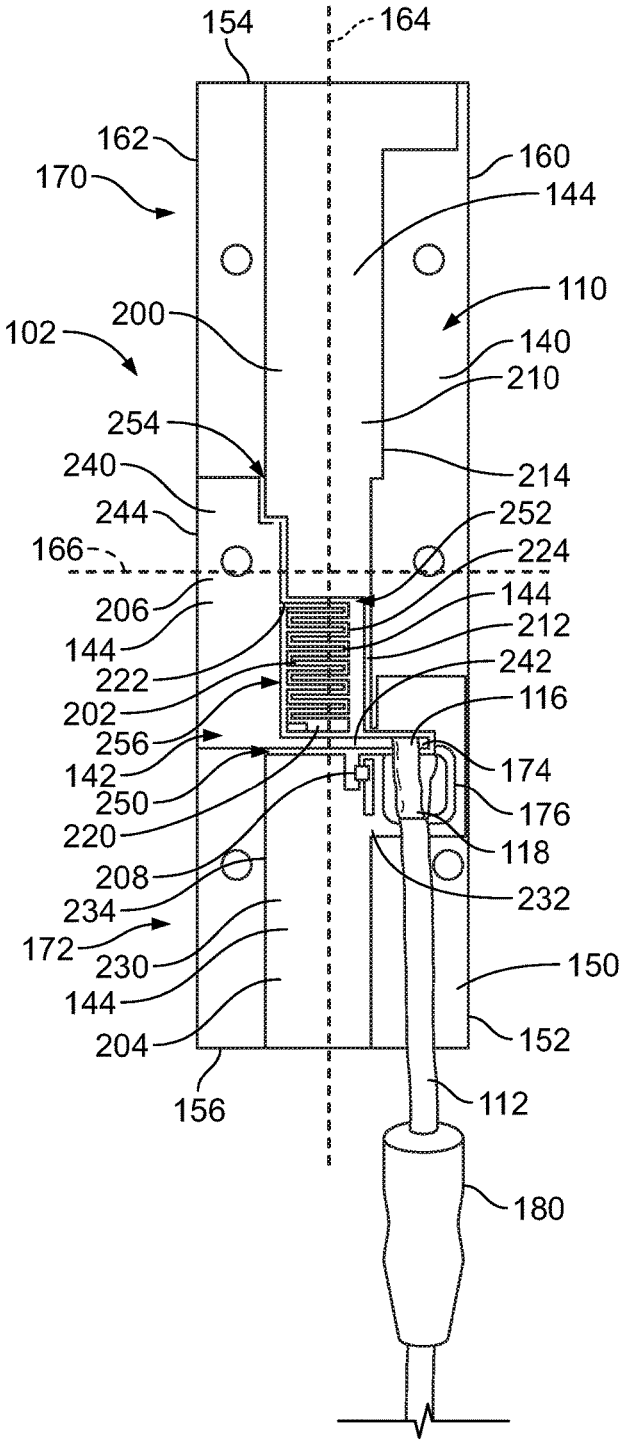
FIG. 3 illustrates the antenna assembly in accordance with an exemplary embodiment.

FIG. 3 illustrates the antenna assembly 102 in accordance with an exemplary embodiment. The antenna element 110 includes a substrate 140 and an antenna circuit 142 on the substrate 140. In an exemplary embodiment, the antenna circuit 142 is a dual dipole antenna circuit; however, other types of antenna circuits may be used in alternative embodiments. The antenna circuit 142 is defined by conductive elements 144 on the substrate 140. The conductive elements 144 may be pads, traces, vias and the like on one or more layers of the substrate 140. In an exemplary embodiment, the substrate 140 is a circuit board. Optionally, the substrate 140 may be a FR4 board. The antenna circuit 142 is defined by the conductive elements 144 being printed on one or more layers of the circuit board. In the illustrated embodiment, the conductive elements 144 are printed on a single layer of the circuit board, such as the outer layer of the circuit board and the circuit board does not need to include a separate ground plane. In other various embodiments, the substrate 140 may be defined by a flex circuit, which may be wrapped around a 3D component. In other alternative embodiments, the substrate 140 may be defined by the structure of the housing, such as the molded plastic defining the housing or case.

The substrate 140 includes a first surface 150 and a second surface 152 opposite the first surface 150. The surfaces 150, 152 define the main surfaces of the substrate 140. In an exemplary embodiment, the conductive elements 144 defining the antenna circuit 142 are formed on the first surface 150 and/or the second surface 152. The substrate 140 extends between a first end 154 (for example, a top end) and a second end 156 (for example, a bottom end) opposite the first end 154. The substrate 140 includes a first side 160 and a second side 162 opposite the first side 160. The first and second ends 154, 156 and the first and second sides 160, 162 define perimeter edges of the substrate 140 between the first and second surfaces 150, 152. The substrate 140 is rectangular in the illustrated embodiment. However, the substrate 140 may have other shapes in alternative embodiments including additional edges.

In an exemplary embodiment, the substrate 140 extends along a longitudinal axis 164 and a lateral axis 166. In the illustrated embodiment, the first and second sides 160, 162 extend parallel to the longitudinal axis 164 and the first and second ends 154, 156 extend parallel to the lateral axis 166. The substrate 140 has a length defined along the longitudinal axis 164 and a width defined along the lateral axis 166. For example, the sides 160, 162 define the length of the substrate 140 and the ends 154, 156 define the width of the substrate 140. In an exemplary embodiment, the antenna element 110 is oriented within the system in a vertical orientation such that the length is a vertical length, and may be describe herein with reference to such orientation.

Optionally, as in the illustrated embodiment, the antenna cable 112 may be terminated to the antenna element 110 at the first surface 150. For example, the feed line 116 may be terminated (for example, soldered) to a feed line mounting pad 174 and the ground shield 118 may be terminated (for example, soldered) to a ground shield mounting pad 176. In an exemplary embodiment, the antenna cable 112 includes a ferrite choke 180 to suppress high frequency noise along the antennal cable 112. The substrate 140 defines an upper portion 170 between the mounting area and the top end 154. The substrate 140 defines a lower portion 172 between the mounting area and the bottom end 156.

In an exemplary embodiment, the antenna circuit 142 is a dual dipole antenna circuit 142 having the various conductive elements 144 used to target different frequency bands. Optionally, the antenna circuit 142 may define a combined left hand/right hand antenna. The antenna circuit 142 may include a plurality of mode elements that are operable in different frequency bandwidths, such as different low band frequencies and different high band frequencies.

In an exemplary embodiment, the dual dipole antenna circuit 142 includes a low band ground terminal 200, a low band feed terminal 202, a high band ground terminal 204 and a high band feed terminal 206 defined by different conductive elements 144. In an exemplary embodiment, the ground elements of the antenna circuit 142 are left-handed mode elements and the feed elements of the antenna circuit 142 are right-handed mode elements. For example, the low band ground terminal 200 is a low band left handed (LBLH) mode element, the low band feed terminal 202 is a low band right handed (LBRH) mode element, the high band ground terminal 204 is a high band left handed (HBLH) mode element, and the high band feed terminal 206 is a high band right handed (HBRH) mode element. Any of such mode elements may be referred to individually as a "mode element" and any combination thereof may be referred to together as "mode elements". In an exemplary embodiment, at least one of the mode elements (for example, terminals 200-206) includes a tuning element 208 associated therewith. Optionally, the tuning elements 208 may be connected to more than mode element.

The feed line 116 is electrically connected to the low band feed terminal 202 and the high band feed terminal 206. The ground shield 118 is electrically connected to the low band ground terminal 200 and the high band ground terminal 204. The ground shield 118 provides the electrical grounding for the low band ground terminal 200 and the high band ground terminal 204 such that the low band ground terminal 200 and the high band ground terminal 204 are ground plane independent. The antenna circuit 142 does not include a separate ground plane within the substrate 140. The substrate 140 does not need to be electrically grounded or commoned to another component within the system. For example, the substrate 140 does not need to be connected to chassis ground or earth ground. The ground terminals 200, 204 are ground plane independent, but rather are referenced only to the ground shield 118 of the antenna cable 112. The various conductive elements 144 may be directly electrically coupled together or may be capacitively coupled together. The sizes, shapes and relative positions of the conductive elements 144 controls antenna characteristics, such as operating frequencies, of the antenna circuit 142.

The low band ground terminal 200 includes a cell 210 connected to the ground shield 118 by a ground bridge 212. The cell 210 may have any size and shape. The cell 210 is defined by a pad on the substrate 140. The size and shape of the cell 210 controls antenna characteristics of the low band ground terminal 200. The cell 210 has a length defined along the longitudinal axis 164 and a width defined along the lateral axis 166. The cell 210 is peripherally surrounded by an edge 214. The edge 214 may define a polygon. Optionally, the width and/or the length of the cell 210 may be non-uniform. For example, the cell 210 may include a notched area(s) that provide a space(s) for other circuits of the antenna 110. In an exemplary embodiment, the cell 210 is a large circuit structure on the substrate 140 occupying approximately 10% or more of the surface area of the substrate 140. The size and shape of the ground bridge 212 controls antenna characteristics of the low band ground terminal 200. A portion of the cell 210 is located in close proximity to the feed element, such as the low band feed terminal 202 and/or the high band feed terminal 206. The feed is capacitively coupled to the cell 210 at such portion. The distance between the cell 210 and the feed controls the amount of capacitive coupling therebetween. A length of the interface between the feed and the cell 210 controls the amount of capacitive coupling therebetween. The amount of capacitive coupling affects the antenna characteristics of the antenna 110. The ground bridge 212 extends between the cell 210 and the ground shield mounting pad 176. The ground bridge 212 provides inductive coupling and/or inductive loading for the cell 210. The ground bridge 212 may tap into the cell 210 at multiple locations with multiple bridges. The amount of inductive loading may be controlled by the number of taps between the ground shield mounting pad 176 and the cell 210. The inductive loading and capacitive coupling of the low band ground terminal 200 may provide a left hand mode of propagation.

The low band feed terminal 202 includes a cell 220 electrically connected to the feed line 116. In the illustrated embodiment, the cell 220 of the low band feed terminal 202 is electrically connected to the feed line 116 through the high band feed terminal 206. For example, a feed bridge 222 is connected between the cell 220 and the high band feed terminal 206. In alternative embodiments, the feed bridge 222 may be directly connected to the feed line mounting pad 174 rather than the high band feed terminal 206. The cell 220 may have any size and shape. In the illustrated embodiment, the cell 220 is defined by a meandering trace having a serpentine shape. The location(s) where the meandering trace taps into the feed, such as into the high band feed terminal 206 may control antenna characteristics of the low band feed terminal 202, such as a frequency of the low band feed terminal 202. The proximity of the meandering trace to the high band feed terminal 206 and/or the ground, such as the low band ground terminal 200, may affect antenna characteristics of the low band feed terminal 202, such as the frequency of the low band feed terminal 202. The length of the meandering trace may affect the antenna characteristics of the low band feed terminal 202. The number of meandered sections may affect the antenna characteristics of the low band feed terminal 202. The proximity of the meandering sections to one another may affect the antenna characteristics of the low band feed terminal 202. The cell 220 is peripherally surrounded by an edge 224.

The high band ground terminal 204 includes a cell 230 connected to the ground shield 118 by a ground bridge 232. The cell 230 may have any size and shape. The cell 230 is defined by a pad on the substrate 140. The size and shape of the cell 230 controls antenna characteristics of the high band ground terminal 204. The cell 230 has a length defined along the longitudinal axis 164 and a width defined along the lateral axis 166. The cell 230 is peripherally surrounded by an edge 234. The edge 234 may define a polygon. Optionally, the width and/or the length of the cell 230 may be non-uniform. For example, the cell 230 may include a notched area(s) that provide a space(s) for other circuits of the antenna 110. In an exemplary embodiment, the cell 230 is a large circuit structure on the substrate 140 occupying approximately 10% or more of the surface area of the substrate 140. The size and shape of the ground bridge 232 controls antenna characteristics of the high band ground terminal 204. Optionally, the high band ground terminal 204 may include multiple ground bridges 232. The size and shape of the ground bridge 232 controls antenna characteristics of the high band ground terminal 204. A portion of the cell 230 is located in close proximity to the feed element, such as the low band feed terminal 202 and/or the high band feed terminal 206. The feed is capacitively coupled to the cell 230 at such portion. The distance between the cell 230 and the feed controls the amount of capacitive coupling therebetween. A length of the interface between the feed and the cell 230 controls the amount of capacitive coupling therebetween. The amount of capacitive coupling affects the antenna characteristics of the antenna 110. The ground bridge 232 extends between the cell 230 and the ground shield mounting pad 176. The ground bridge 212 provides inductive coupling and/or inductive loading for the cell 230. The ground bridge 232 may tap into the cell 230 at multiple locations with multiple bridges. The amount of inductive loading may be controlled by the number of taps between the ground shield mounting pad 176 and the cell 230. The inductive loading and capacitive coupling of the high band ground terminal 204 may provide a left hand mode of propagation.

The high band feed terminal 206 includes a cell 240 connected to the feed line 116 by a feed bridge 242. The cell 240 may have any size and shape. The cell 240 is defined by a pad on the substrate 140. The size and shape of the cell 240 controls antenna characteristics of the high band feed terminal 206. The cell 240 has a length defined along the longitudinal axis 164 and a width defined along the lateral axis 166. The cell 240 is peripherally surrounded by an edge 244. The edge 244 may define a polygon. Optionally, the width and/or the length of the cell 240 may be non-uniform. For example, the cell 240 may include a notched area(s) that provide a space(s) for other circuits of the antenna 110. In an exemplary embodiment, the cell 240 is a large circuit structure on the substrate 140 occupying approximately 10% or more of the surface area of the substrate 140. The size and shape of the feed bridge 242 controls antenna characteristics of the high band feed terminal 206.

In an exemplary embodiment, the low band ground terminal 200 and the high band ground terminal 204 are connected by the ground shield mounting pad 176 and the ground bridges 212, 232. In an exemplary embodiment, the low band feed terminal 202 and the high band feed terminal 206 are connected by the feed bridge 222. In an exemplary embodiment, the high band ground terminal 204 is separated from the high band feed terminal 206 by a gap 250. The high band ground terminal 204 is capacitively coupled to the high band feed terminal 206 across the gap 250. In an exemplary embodiment, the low band ground terminal 200 is separated from the low band feed terminal 202 by a gap 252. The low band ground terminal 200 is capacitively coupled to the low band feed terminal 202 across the gap 252. In an exemplary embodiment, the low band ground terminal 200 is separated from the high band feed terminal 206 by a gap 254. The low band ground terminal 200 is capacitively coupled to the high band feed terminal 206 across the gap 254. In an exemplary embodiment, the high band feed terminal 206 is separated from the low band feed terminal 202 by a gap 256. The feed bridge 222 extends across the gap 256. The sizes and shapes of the gaps 250, 252, 254, 256 control antenna characteristics of the antenna circuit 142.

In an exemplary embodiment, the antenna circuit 142 is asymmetric. For example, the sizes and shapes of the low band terminals 200, 202 may be different than the sizes and shapes of the corresponding high band terminals 204, 206. In an exemplary embodiment, the low band ground terminal 200 is longer compared to the high band ground terminal 204. The cell 210 may have a different surface area than the cell 230. The lengths and/or the widths of the ground terminals 200, 204 may affect the target frequencies of the dual dipole antenna circuit 142. In an exemplary embodiment, the low band feed terminal 202 has a meandering or serpentine shape, whereas the high band feed terminal 206 is generally rectangular. The lengths and/or the widths of the feed terminals 202, 206 may affect the target frequencies of the dual dipole antenna circuit 142.

Optionally, the ground terminals 200, 204 may be asymmetrical relative to the feed terminals 202, 206 due to the relative locations of the terminals to the antenna cable 112. For example, in an exemplary embodiment, the antenna cable 112 may be routed along, and thus is located closer to, the high band ground terminal 200 compared to the low band feed terminal 202, which may affect the antenna characteristics of the antenna circuit 142. The sizes and shapes of the conductive elements 144 may be selected to be asymmetrical to accommodate for the position of the antenna cable 112 relative to the conductive elements 144. The asymmetrical sizes and shapes of the cells 210, 220, 230, 240 may accommodate for the relative positions of the antenna cable 112 and the conductive elements 144.

In an exemplary embodiment, the high band ground terminal 204 is located generally below the mounting area, whereas the low band ground terminal 200, the low band feed terminal 202 and the high band feed terminal 206 are located generally above the mounting area. In an exemplary embodiment, the mounting area is located proximate to the first side 160 of the substrate 140. The high band feed terminal 206 is located proximate to the second side 162 of the substrate 140. The low band ground terminal 200, the high band ground terminal 204 and the low band feed terminal 202 are approximately centered between the first and second sides 160, 162. Other locations are possible in alternative embodiments.

In an exemplary embodiment, the tuning elements 208 may be by variable capacitors. Other types of tuning elements may be used in alternative embodiments. For example, the tuning element 208 may be a ferroelectric capacitor having a voltage dependent dielectric constant to change a capacitance thereof, such as a Barium Strontium Titanate (BST) capacitor. In other embodiments, the tuning element 208 may be a varactor diode, a MEMS switched capacitor, an electronically switched capacitor, and the like. Other types of tuning elements may be used on alternative embodiments. The tuning elements 208 are used to dynamically affect the antenna characteristics of one or more of the mode elements. For example, the frequency, bandwidth, impedance, gain, loss, and the like of the mode element may be tuned or adjusted by the tuning element 208.

The tuning elements 208 may be operably coupled to a controller or processor to control operation thereof. For example, the controller may adjust one or more characteristic of the tuning element 208 to affect the operation of the tuning element. Optionally, the tuning element 208 may be controlled by varying a voltage applied to the tuning element 208. The controller may control the voltage supplied to the tuning element 208 to control operation of the tuning element 208. The tuning of the tuning elements 208 may be electrically tuned via the controller in response to an internal program or one or more external signals, such as signals received by the antenna 110. Alternatively, the tuning elements 208 may be controlled by a manual operated switch.

Figure 4:
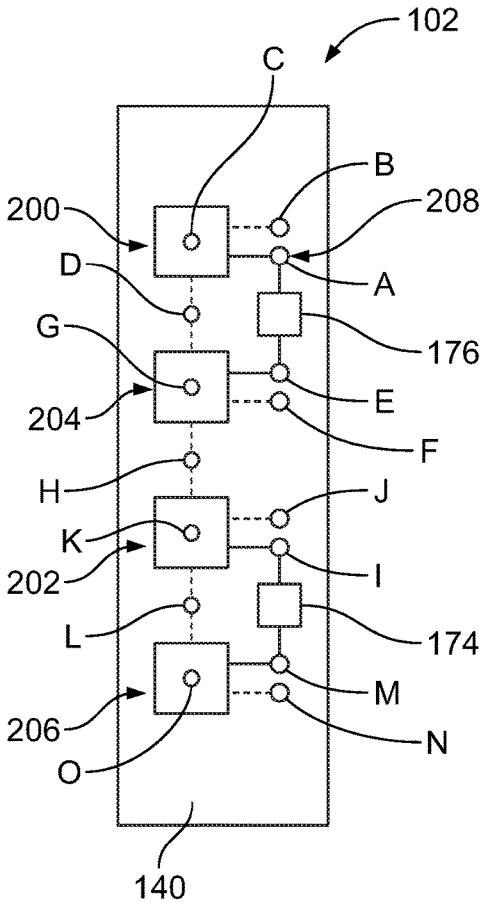
FIG. 4 is a schematic illustration of an antenna of the antenna assembly.

FIG. 4 is a schematic illustration of the antenna 110. The terminals 200-206 are shown on the substrate 140. The terminals 200-206 are defined by circuit traces and the antenna 110 has at least one circuit trace electrically connected to the corresponding feed line mounting pad 174 or the ground shield mounting pad 176. Various locations for placement of the tuning elements 208 are shown in FIG. 3. For example, for tuning effect on the low band ground terminal 200, a tuning element 208 may be placed 1) at location A in series along the circuit trace; 2) at location B along a shunt defined by a circuit trace; 3) at location C on the low band ground terminal 200; and/or 4) at location D on the connecting circuit trace between the low band ground terminal 200 and the high band ground terminal 204 (or other mode elements).

For tuning effect on the high band ground terminal 204, for example, a tuning element 208 may be placed 1) at location E in series along a circuit trace; 2) at location F along a shunt defined by a circuit trace; 3) at location G on the high band ground terminal 204; 4) at location D on a connecting circuit trace between the 1 high band ground terminal 204 and the low band ground terminal 200; and/or 5) at location H on a connecting circuit trace between the high band ground terminal 204 and the low band feed terminal 202 (or other mode elements).

For tuning effect on the low band feed terminal 202, for example, a tuning element 208 may be placed 1) at location I in series along a circuit trace; 2) at location J along a shunt defined by a circuit trace; 3) at location K on the hi low band feed terminal 202; 4) at location H on a connecting circuit trace between the high band ground terminal 204 and the low band feed terminal 202; and/or 5) at location L on a connecting circuit trace between the low band feed terminal 202 and the high band feed terminal 206 (or other mode elements).

For tuning effect on the high band feed terminal 206, for example, a tuning element 208 may be placed 1) at location M in series along a circuit trace; 2) at location N along a shunt defined by a circuit trace; 3) at location O on the high band feed terminal 206; and/or 4) at location L on a connecting circuit trace between the high band feed terminal 206 and the high band ground terminal 204 (or other mode elements).

The tuning elements 208 may have other placements in alternative embodiments. The tuning elements 208 are used to dynamically affect the antenna characteristics of one or more of the terminals 200-206. For example, the resonant frequency of one or more of the terminals 200-206 may be tuned or adjusted by the tuning element 208. The tuning element 208 may be used to match the impedance or other characteristic of the terminal 200-206 with another terminal 200-206 or other electrical component of the antenna 110.

Figure 5:
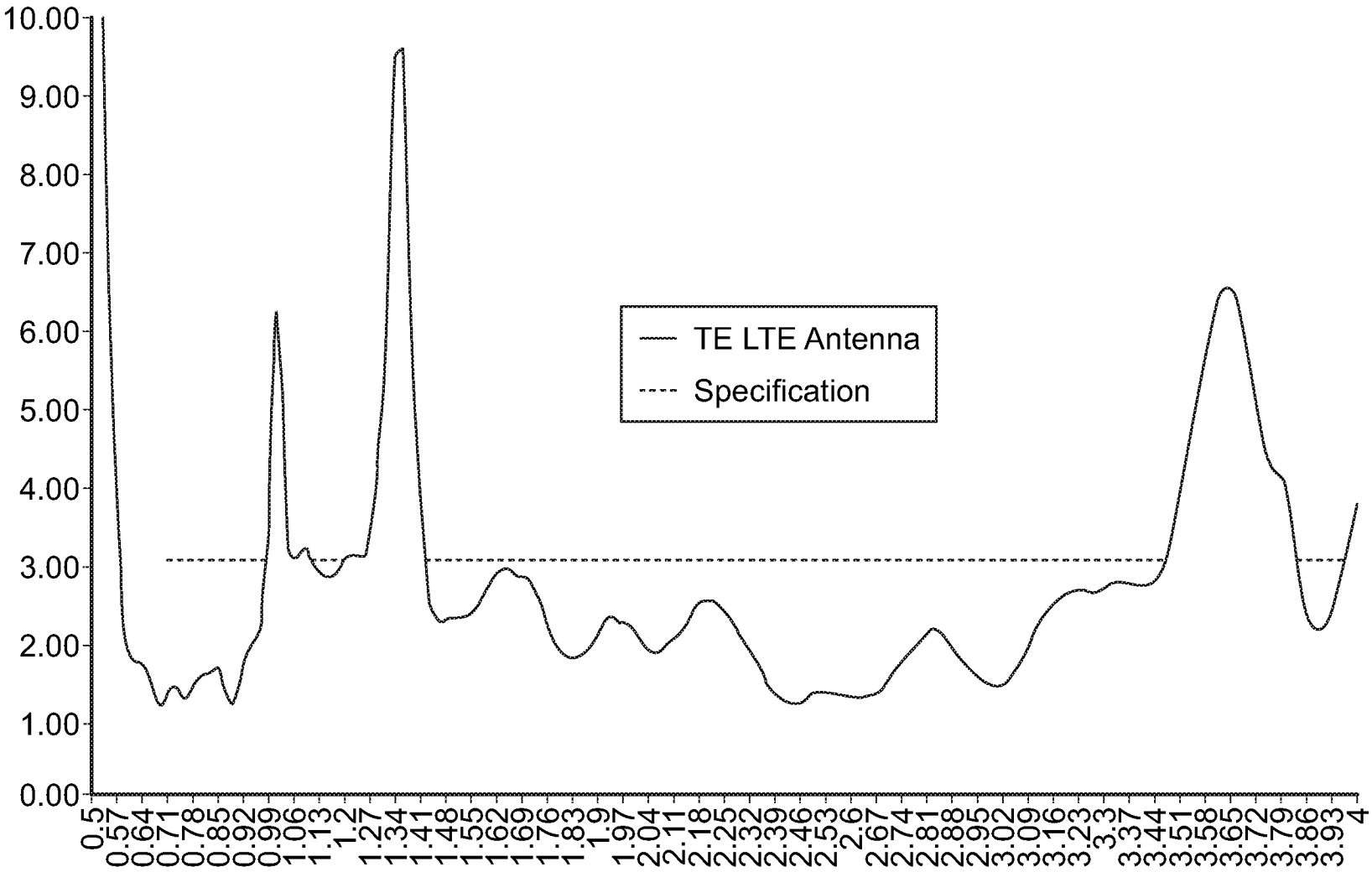
FIG. 5 illustrates a VSWR simulation of the antenna showing values at various frequencies.

FIG. 5 illustrates a VSWR simulation of the antenna 110 showing values at various frequencies. The antenna 202 has good performance at multiple frequency bands. For example, the terminals 200-206 resonate at multiple frequencies, such as within frequency ranges of 698 to 960 MHz, 1.4 to 3.5 GHz and 3.8 to 4 GHz, which provides frequency coverage and enables use in many different and discrete worldwide cellular bands. The resonant frequencies of the elements may be different by changing design characteristics of the circuit traces (e.g., size, shape, location, and the like). The resonant frequencies may be dynamically adjusted by the tuning element(s) 208.

The antennas and tuning elements described herein provide multiple antenna elements, any of which can be tuned to control antenna characteristics thereof. The elements can be designed (for example, sized, shaped, positioned) or tuned for operation in a wide bandwidth. For example, having the dual dipole antenna allows the antenna element to operate in multiple frequency bands, providing a wide bandwidth antenna. The antenna is provided on a substrate having a small physical size. The antenna is provided on a substrate that does not have a ground plane. Thus, the antenna elements are ground plane independent. The antennas described herein are operable in multiple frequency bands simultaneously. The dual dipole antenna circuit permits a single mechanical embodiment of an antenna and wireless device to accommodate a variety of different frequency bands, which provides manufacturing and assembly economy. The same wireless device may be operated efficiently in different geographic location, different networks, and the like. By way of example, the wireless device may be operable in different cellular networks. The wireless device may be operable on both a cellular network and a wireless network. By way of another example, the wireless device may be usable in different geographic locations, such as different countries, which utilize different frequency bands.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An antenna assembly for a wireless device, the antenna comprising:

an antenna cable having a feed line and a ground shield coaxial with the feed line;

a substrate having a feed line mounting pad and a ground shield mounting pad;

a low band ground terminal on the substrate and operable in a low frequency bandwidth, the low band ground terminal being electrically coupled to the ground shield of the antenna cable and being capacitively coupled to the feed line of the antenna cable;

a low band feed terminal on the substrate and operable in a low frequency bandwidth, the low band feed terminal being electrically coupled to the feed line of the antenna cable;

a high band ground terminal on the substrate and operable in a high frequency bandwidth, the high band ground terminal being electrically coupled to the ground shield of the antenna cable and being capacitively coupled to the feed line of the antenna cable; and a high band feed terminal on the substrate and operable in a high frequency bandwidth, the high band feed terminal being electrically coupled to the feed line of the antenna cable;

wherein the low band ground terminal and the high band ground terminal are ground plane independent.

2. The antenna assembly of claim 1, wherein the substrate does not include a ground plane.

3. The antenna assembly of claim 1, wherein the substrate is a printed circuit board, all of the circuits of the printed circuit board being provided on a single layer of the printed circuit board.

4. The antenna assembly of claim 1, wherein the substrate has discrete conductive elements defining the low band ground terminal, the low band feed terminal, the high band ground terminal and the high band feed terminal, wherein the conductive element defining the low band ground terminal is capacitively coupled to the conductive element defining the low band feed terminal, and wherein the conductive element defining the high band ground terminal is capacitively coupled to the conductive element defining the high band feed terminal.

5. The antenna assembly of claim 4, wherein the conductive element defining the high band feed terminal includes a first cell and a first bridge between the first cell and the feed line mounting pad, the conductive element defining the low band feed terminal includes a meandering trace electrically connected to the feed line mounting pad, the conductive element defining the low band ground terminal includes a second cell and a second bridge extending between the second cell and the ground shield mounting pad, the conductive element defining the high band ground terminal includes a third cell and a third bridge extending between the third cell and the ground shield mounting pad.

6. The antenna assembly of claim 5, wherein the meandering trace taps into the first cell.

7. The antenna assembly of claim 4, wherein the conductive element defining the low band ground terminal is capacitively coupled to the conductive element defining the high band feed terminal.

8. The antenna assembly of claim 4, wherein the conductive element defining the low band ground terminal is separated from the conductive element defining the low band feed terminal by a first gap, and wherein the conductive element defining the high band ground terminal is separated from the conductive element defining the high band feed terminal by a second gap.

9. The antenna assembly of claim 1, further comprising a tuning element on the substrate, the tuning element being operatively coupled to at least one of the low band ground terminal, the low band feed terminal, the high band ground terminal and the high band feed terminal.

10. The antenna assembly of claim 9, wherein the tuning element comprises one of a variable capacitor, a varactor diode, a MEMS switched capacitor, or an electronically switched capacitor.

11. The antenna assembly of claim 9, wherein the tuning element is coupled in series with the corresponding at least one of the low band ground terminal, the low band feed terminal, the high band ground terminal and the high band feed terminal.

12. The antenna assembly of claim 9, wherein the tuning element is provided as a shunt for the corresponding at least one of the low band ground terminal, the low band feed terminal, the high band ground terminal and the high band feed terminal.

13. The antenna assembly of claim 9, wherein the tuning element is operatively coupled to at least two of the low band ground terminal, the low band feed terminal, the high band ground terminal and the high band feed terminal, the tuning element providing matched tuning for the corresponding low band ground terminal, the low band feed terminal, the high band ground terminal and the high band feed terminal.

14. An antenna assembly for a wireless device, the antenna comprising:

an antenna cable having a feed line and a ground shield coaxial with the feed line;

a substrate having discrete conductive elements defining a feed line mounting pad, a ground shield mounting pad, a low band ground terminal, a low band feed terminal, a high band ground terminal and a high band feed terminal the low band ground terminal being operable in a low frequency bandwidth, the low band ground terminal being electrically coupled to the ground shield of the antenna cable and being capacitively coupled to the feed line of the antenna cable, wherein the conductive element defining the low band ground terminal is capacitively coupled to the conductive element defining the low band feed terminal;

the low band feed terminal being operable in a low frequency bandwidth, the low band feed terminal being electrically coupled to the feed line of the antenna cable;

the high band ground terminal being operable in a high frequency bandwidth, the high band ground terminal being electrically coupled to the ground shield of the antenna cable and being capacitively coupled to the feed line of the antenna cable, wherein the conductive element defining the high band ground terminal is capacitively coupled to the conductive element defining the high band feed terminal; and the high band feed terminal operable in a high frequency bandwidth, the high band feed terminal being electrically coupled to the feed line of the antenna cable;

wherein the low band ground terminal and the high band ground terminal are ground plane independent.

15. The antenna assembly of claim 14, wherein the substrate does not include a ground plane.

16. The antenna assembly of claim 14, wherein the conductive element defining the high band feed terminal includes a first cell and a first bridge between the first cell and the feed line mounting pad, the conductive element defining the low band feed terminal includes a meandering trace electrically connected to the feed line mounting pad, the conductive element defining the low band ground terminal includes a second cell and a second bridge extending between the second cell and the ground shield mounting pad, the conductive element defining the high band ground terminal includes a third cell and a third bridge extending between the third cell and the ground shield mounting pad.

17. The antenna assembly of claim 14, wherein the conductive element defining the low band ground terminal is separated from the conductive element defining the low band feed terminal by a first gap, and wherein the conductive element defining the high band ground terminal is separated from the conductive element defining the high band feed terminal by a second gap.

18. The antenna assembly of claim 14, further comprising a tuning element on the substrate, the tuning element being operatively coupled to at least one of the low band ground terminal, the low band feed terminal, the high band ground terminal and the high band feed terminal.

19. An antenna assembly for a wireless device, the antenna comprising:

an antenna cable having a feed line and a ground shield coaxial with the feed line;

a substrate having a feed line mounting pad and a ground shield mounting pad;

a low band ground terminal on the substrate and operable in a low frequency bandwidth, the low band ground terminal being electrically coupled to the ground shield of the antenna cable and being capacitively coupled to the feed line of the antenna cable;

a low band feed terminal on the substrate and operable in a low frequency bandwidth, the low band feed terminal being electrically coupled to the feed line of the antenna cable;

a high band ground terminal on the substrate and operable in a high frequency bandwidth, the high band ground terminal being electrically coupled to the ground shield of the antenna cable and being capacitively coupled to the feed line of the antenna cable;

a high band feed terminal on the substrate and operable in a high frequency bandwidth, the high band feed terminal being electrically coupled to the feed line of the antenna cable; and a tuning element on the substrate, the tuning element being operatively coupled to at least one of the low band ground terminal, the low band feed terminal, the high band ground terminal and the high band feed terminal;

wherein the low band ground terminal and the high band ground terminal are ground plane independent.

20. The antenna assembly of claim 19, wherein the substrate has discrete conductive elements defining the low band ground terminal, the low band feed terminal, the high band ground terminal and the high band feed terminal, wherein the conductive element defining the low band ground terminal is capacitively coupled to the conductive element defining the low band feed terminal, and wherein the conductive element defining the high band ground terminal is capacitively coupled to the conductive element defining the high band feed terminal.

* * * * *